United States Patent [19]

Machnikowski

[11] 4,024,832

[45] May 24, 1977

[54] BOOKMARKER

[76] Inventor: Frank J. Machnikowski, 13528 S. Brandon, Chicago, Ill. 60633

[22] Filed: Apr. 28, 1975

[21] Appl. No.: 572,265

[52] U.S. Cl. ..... 116/119
[51] Int. Cl.[2] ..... B42D 9/00
[58] Field of Search ..... 116/119; 281/42; 40/352; 24/67.9

[56] References Cited

UNITED STATES PATENTS

| | | | |
|---|---|---|---|
| 957,447 | 5/1910 | Suddick | 281/42 |
| 1,193,421 | 8/1916 | Prettyman | 116/119 |
| 2,116,147 | 5/1938 | Haessler | 116/119 |
| 2,584,389 | 2/1952 | Kuhn | 116/119 |
| 3,159,137 | 12/1964 | Baldwin | 116/119 |
| 3,381,654 | 5/1968 | Hupp | 116/119 |
| 3,425,389 | 2/1969 | Sacco et al. | 116/119 |
| 3,697,100 | 10/1972 | Hawkins | 281/42 |
| 3,712,712 | 1/1973 | Bosma | 116/119 |

FOREIGN PATENTS OR APPLICATIONS

| | | | |
|---|---|---|---|
| 799,211 | 8/1958 | United Kingdom | 116/119 |

*Primary Examiner*—S. Clement Swisher
*Assistant Examiner*—Denis E. Corr
*Attorney, Agent, or Firm*—Gary, Juettner

[57] ABSTRACT

A bookmarker comprises an inserted or first section adapted to extend along one side of a page or leaf of a book or the like, a tongue extending from the first section and adapted to extend on the other side of the page or leaf and cooperating with the first section to hold the marker to the page or leaf with a wedging action, and a flexible second section which is adapted to extend from the first section and the page or leaf. The first section or second section, which is visible even if the book is closed, may carry printed or written messages. The relative flexibility of the second section permits the bookmarker to bend should the marker be forced toward the book, as if dropped, or even tapped slightly, so that the pages of the book are not damaged.

1 Claim, 8 Drawing Figures

BOOKMARKER

DESCRIPTION

This invention relates to markers for use with paper leaves or sheets and more particularly for bookmarkers for attachment to the paper leaves or sheets of a book to convey a message and/or locate position therein.

SUMMARY OF THE PRIOR ART

Heretofore, various type devices such as ribbons or slips of paper have been used as bookmarkers to locate a position in a book, and frequently such markers carried pre-printed advertisements or were written on by the user to convey a meassage, this being particularly true for slips of paper. However, markers of the ribbon or paper slip type did not retain themselves to the page and frequently fell out if the book or papers were mishandled or fell. While such markers could be attached with a device such as a paper clip or staple, this procedure necessitated additional operations, required a supply of such fasteners and also introduced the possibility of damaging the paper or leaf. Older and glit-edged books are particularly subject to damage by the introduction of even slightly rigid bookmarkers therein.

In U.S. Pat. No. 2,609,629 issued on Sept. 9, 1952 to J.R. Hubbard, a wedge type bookmarker is shown. While this book marker provides adequate retention of the marker to the papers, it has the disadvantage that the portion extending above the book is rigid. Thus, should the book be dropped on the marker and the exposed portion of the marker struck, the remainder of the marker will be forced onto the page and damage the same.

Various attempts, such as U.S. Pat. No. 2,717,572, have been made to alleviate the problem by shortening the exposed portion of the marker to only a fraction of an inch so as not to extend beyond the cover of a hard bound book. Such attempts offer no protection to soft cover books since the covers and pages of such books are the same size and offer little protection to hard books since such books twist or distort when dropped and the short markers are still driven into the pages. Such a marker was still capable of damaging a book should it be inadvertently tapped by the finger of the reader. Additionally, such markers have the disadvantage of not being visible in a hard bound book should it be closed and barely visible in a paperback book so as to attract the attention of the reader. Further, the exposed portion of such marker was usually too small an area to display a message or advertisement. Also such type markers usually provide too small an area to adequately join together the elements of a two-element type device.

The foregoing disadvantage have been overcome by the bookmarker of the present invention which has an area onto which a message may be printed or written and is constructed so that the exposed portion is flexibe and will bend to avert damaging the book. Additionally, the bookmarker of the present invention can be used in the manner of a paper clip to temporarily fasten sheets of paper together or may be used in conjunction with fastening means to more permanently fasten the sheets together and avoid having the fastening means damage the papers by tearing.

One object of the bookmarker of the present invention is to provide marking or message means which can be placed in a book, or the like papers, without danger of damaging the book should the marker be forced into the book.

Another object is to provide a flexible bookmarker which itself will bend rather than damage the papers to which it is attached should the bookmarker be forced toward the papers.

Yet another object is to provide such a bookmarker which is visible at all times even when the book in which it is placed is closed.

Yet another object is to provide a bookmarker which has a surface for bearing messages and has economically fabricated means for attachment to papers or the like.

These and other objects of the bookmarker of the present invention will become apparent from the accompanying figures of the drawings and the following written description.

DESCRIPTION OF THE PREFERRED EMBODIMENTS

Figure 1:
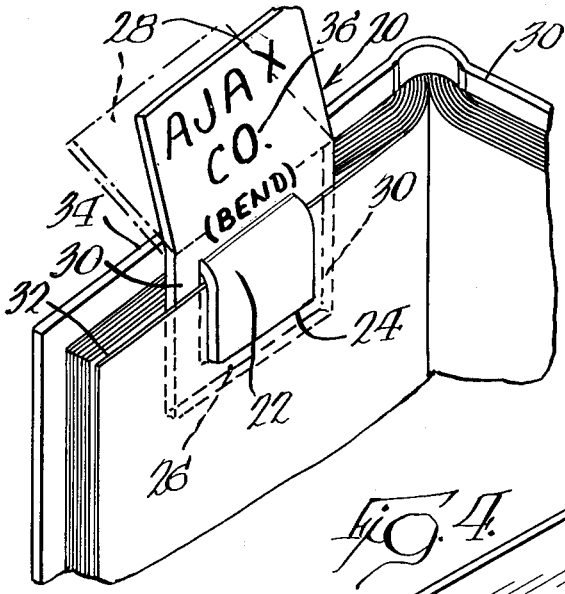
FIG. 1 is a perspective view of a first embodiment of bookmarker of the present invention in place in a book, with a portion of the marker shown in a second position in dash-dot lines.

Referring to FIG. 1, a bookmarker 20 of the present invention comprises a single sheet of material, such as paper or card stock, having two sections 26 and 28. Section 26 has an integral tongue 22 formed or cut therefrom. At one end the tongue is fixed or integral with the sheet while the other opposite end 24 is free so that the tongue may be pivoted away from the remainder of the sheet. The remainder of the inserted or first section 26 is below or adjacent the free end of the tongue and the exposed or second section 28 is above or adjacent the fixed end, the first section including two strip sections 30 connected to the second section and on opposite sides of the tongue.

The tongue 22 is adapted to be separated from the first section 26 and connecting strips 30 so that the tongue and connecting strips and the remainder of the first section 26 can be slipped over or inserted on to the edge of one or more pages 32 of a book while the second section extends from the pages and also the cover 34 of the book so that this section of the bookmarker is readily visible, even with the book closed. A message 36 may be pre-printed or written by the user of the bookmarker, particularly on the secon section which is visible at all times even should the book be closed.

In order for the first section 26, including connecting strips 30 and tongue 22, grip or hold the page or pages wedged therebetween, these parts must be relatively stiff or rigid as compared to the paper pages of the book. But should the entire bookmarker be rigid or stiff, including the second section 28, there is a danger that should the book containing the bookmarker 20 be dropped, or the bookmarker 20 otherwise forced relatively toward the book, such as when being positioned thereon, that the page on which the marker is secured or adjacent pages will be damaged. To alleviate this danger, the second section 28 extending from the page and cover of the book is relatively flexible so as to bend or yield rather than force the first section into the book. This flexiblity can be achieved in various manners, such as bending (as shown in dash-dot lines in FIG. 1), curving or curling the section 28 slightly so that it will curve or bend further if the book should be dropped with the exposed, visible section 28 being stuck first so that little or no damage occurs. The initial bend may be imparted to the marker during manufacturing or by instructing the user to do so before placing the marker in a book, as is shown in FIG. 1, wherein the dotted line and word "BEND" are printed on the marker 20. As an alternative, the flexible or weakened section may be provided by scoring or folding. For maximum protection of the book, the flexible or weakend portion should be closed to the edge of the book, i.e., at the junction of the second section to the remainder of the marker.

The marker can be temporarily placed in the book to locate specific pages, or can be more permanently attached as by fastening means such as glue, tape or staples to function as an index tab. Additionally, the marker 20 could function in the manner of a paper clip to hold several sheets of paper, either of a book or otherwise, together. As used in this application, flexibility and rigidity are relative terms and should be measured with respect to the book leaves for which the bookmarker is intended to be used. Paper or card stock from which the bookmarker could be made for used with ordinary books would be within a range of 105 pound to 28 pound stock, and preferably in the range of 65 pound stock to 28 pound stock. Use of stock heavier than 105 pound for the marker tends to cause injury to the book since it is relatively inflexible unless deeply scored or folded, and stock, such as 16 pound stock, would be preferred for fragile, older or gilt-edged book. Manifold paper, approximately 9 pound, is very difficult to imprint and barely usable.

Figure 2:
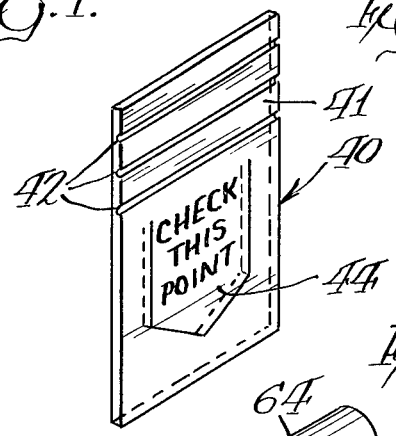
FIG. 2 is a perspective view of a second embodiment of bookmarker of the present invention.

Referring to FIG. 2, a marker 40, similar to marker 20, is shown, the primary difference being that one side of the second section 41 has cuts or scoring 42 parallel to the page edge of the book to provide the necessary flexibility. Another difference is that the free end 44 of the tongue is pointed to act as an indicator should that be desired.

Figure 3:
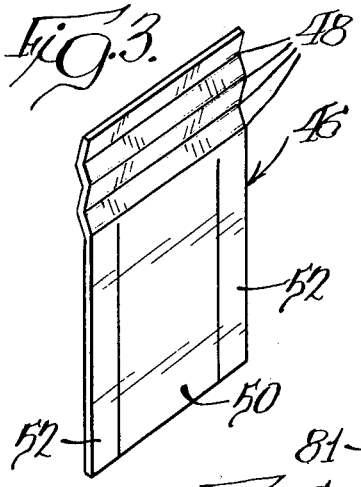
FIG. 3 is a perspective view of a third embodiment of bookmarker of the present invention.

Referring to FIG. 3, a bookmarker 46, similar to markers 20 and 40, comprises a second section having a plurality of folds or creases 48 therein to provide the requisite flexibility. In addition to the folding, another difference is that the free end 50 of the tongue extends from just below the fold to the bottom of the marker so that the strips 52 along side the tongue are only joined at one end to the second section. This construction provides a marker whose rigid portion is entirely within the book.

Figure 4:
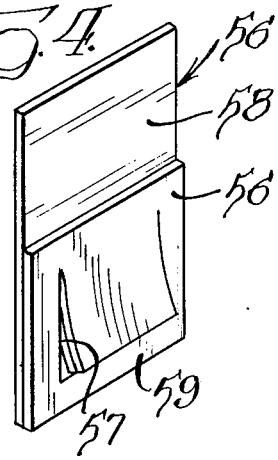
FIG. 4 is a perspective view of a fourth embodiment of bookmarker of the present invention.

Referring to FIG. 4, a bookmarker 56 comprises a composite thick-thin member having a first sheet 58 extending to form a portion of the first section and the second section. The remaining portion of the first section is formed by a second sheet 59 bonded or secured, as by gluing to the first sheet. A cut 57 forming the tongue is made through both sheets 58 and 59. The requisite stiffness for the first section is provided by its double ply thickness, while the flexibility for the second section is provided by its single ply thickness. Another approach to achieve flexibility, usable with this bookmarker, is to use a more flexible material for the sheet 58 than for sheet 59.

Figure 5:
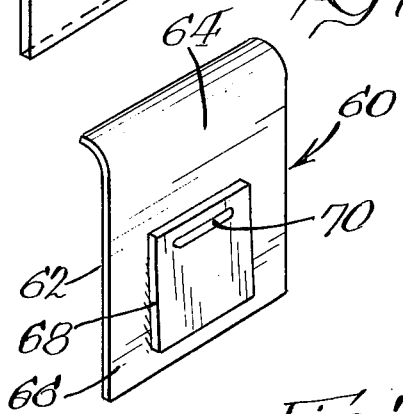
FIG. 5 is a perspective view of a fifth embodiment of bookmarker of the present invention.

Referring to FIG. 5, a bookmarker 60 comprises a first sheet 62 forming the first and second sections 64 and 66 respectively and a second sheet 68, forming a tongue secured to the first sheet as by fastening means, such as a staple 70. The flexibility for the second section is again provided by the slight curvature imparted thereto.

Figure 6:
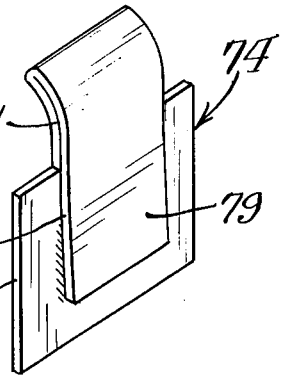
FIG. 6 is a perspective view of a sixth embodiment of bookmarker of the present invention.

Referring to FIG. 6, a bookmarker 74 comprises a first sheet 76 providing part of the first and second sections and a second sheet 78 providing the remainder of the second section and the tongue 79. The adjacent portions of the second section are fastened together by means, such as glue 81. Here the requisite flexibility for the second section is provided by the smaller cross-sectional area thereof, as compared to the larger first section, and the curvature imparted thereto.

Figure 7:
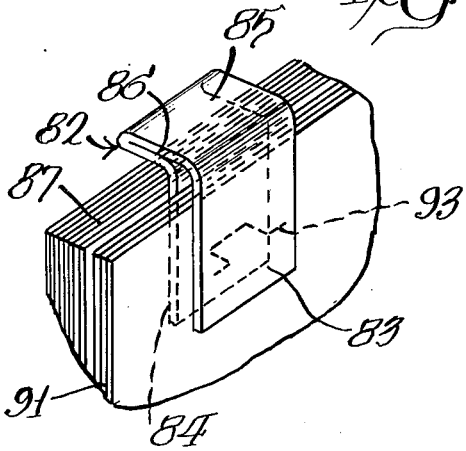
FIG. 7 is a perspective view of a seventh embodiment of bookmarker of the present invention, in place on several sheets of paper.

Referring to FIG. 7, bookmarker 82 comprises a single sheet which is folded over to provide the tongue 83 and first and second sections 84 and 85 respectively. The adjacent portions of the sheet forming the exposed sections are fastened or bonded together as by glue 86. The necessary flexibility for the exposed section is provided by the curvature imparted thereto so that the second section 85 is substantially flush with the edges 87 of the pages. Should it be desired the bookmarker can be used as a paper clip to temporarily fasten loose sheets together by wedging them between the tongue 83 and the first section 84. If a more permanent type fastening is desired a fastener, such as staple 93 (indicated in dashed lines), could be used to secure the tongue 83, papers 91 and section 84 together, the marker serving to protect the papers from tearing.

Figure 8:
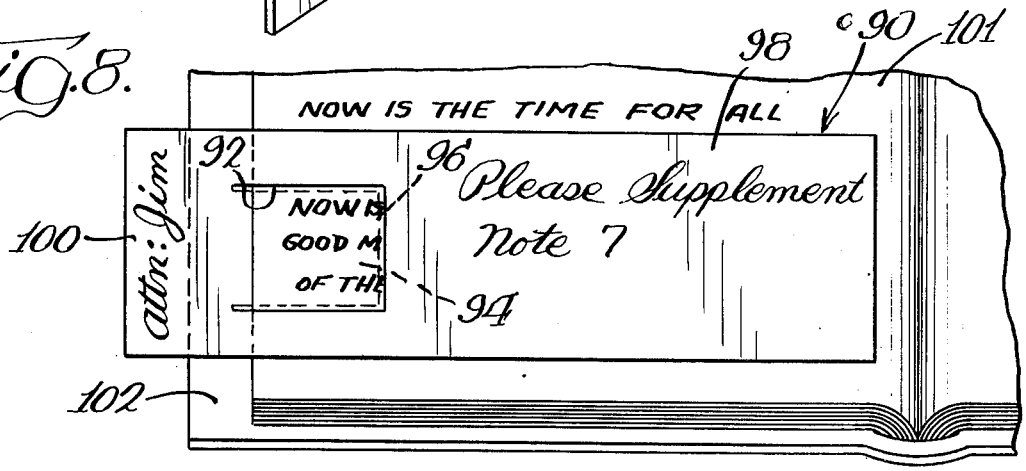
FIG. 8 is a plan view of an eighth embodiment of bookmarker of the present invention in place on a manuscript.

Referring to FIG. 8, a bookmarker 90 comprises a single sheet having a generally "U" shaped cut 92 therein to form a tongue 94. The tongue has a free end 96 and the opposite side integral with the sheet so that the tongue may pivot. The remainder of the sheet forms a first section 98 and an always exposed or visible second section 100 adjacent the fixed end of the tongue. The first section is several times longer than the second section (measured in a horizontal direction as shown in FIG. 8) and is designed to extend substantially across the length or width of the page 101, with which the marker is intended to be used. Either one or both of the first and second sections may carry preprinted message or messages written by the user of the marker, as is shown in FIG. 8. The marker is particularly advantageous for editorial work where the marker may be affixed to the page requiring editing, or over the particular passage to be changed. The second section 100 of the marker extends out beyond the cover 102 of the manuscript so as to be visible, even if it is closed, to catch a person's attention.

While the various means of providing the requisite flexibility to the second section of the marker, such as the imparted bend or curvature, folding or scoring, have been shown with reference to a particular marker, the various means could be used with any of the markers shown. Also, while a message bearing area has been provided at a specific location on certain of the markers, such areas could be otherwise located on any of the markers. While certain of the markers are shown functioning as bookmarkers or the like, they also could be used as a paper holding device with the several sheets of paper wedged between portions thereof. In certain of the markers fastening means are used; such could be glue, staples or tape or the like. Though, preferably, the markers are made of paper or card stock other suitable thin and flexible materials such as plastic or metal could be used, including very soft plastic sheet material. The configuration of the tongue may vary, for example, rectangular, polygonal, circular arc or irregular. Similar variations in the shape of the first and second sections of the marker could be made.

While only the preferred embodiments of bookmarkers of the present invention have been illustrated and described, from the foregoing it is understood that variations, modifications and equivalent structures fall within the scope of the appended claims.

What is claimed is:

1. A bookmarker adapted to be placed between one or more leaves of a book, but being freely removable therefrom, said bookmarker comprising an integral sheet of single ply paper material of a thickness substantially greater than and an initial flexibility substantially less than that of the leaves of the book, said sheet material being between 28 to 65 pound in weight and forming a first section for securing the marker to the leaves and an adjacent second section extending a substantial distance above and from the leaves, said first section having an integral rectangular tongue cut therefrom, said tongue having a free end extending away from said second section, the remainder of said first section and said tongue being adapted to engage the leaves therebetween to hold said bookmarker temporarily in place on the leaves, indicia adjacent the juncture of said first and second sections for indicating said first section should be bent at an angle relative to said second section, said first section being bent at an obtuse angle to said second section at said juncture to form a weakened section to increase the flexibility of said bookmarker to that greater than the leaves of the book, said second section extending substantially above the leaves of the book, being out of contact with the same and having both sides thereof observable even with the book closed, said second section carrying a written message to be conveyed to the user of the book, whereby should said bookmarker be in place in the book, the message is visible, and should the book be dropped so that the extended second section of said bookmarker is struck, said bookmarker flexes at the weakend junction between the first and second sections and prevents said tongue and remaining portion of the first section from being driven inward onto the leaves to prevent damaging the book.

* * * * *